United States Patent [19]

Germain et al.

[11] 4,430,817

[45] Feb. 14, 1984

[54] CARD STORAGE APPARATUS

[75] Inventors: George D. Germain, Westminster; Donald M. Luby, Weston, both of Mass.

[73] Assignee: Simplex Time Recorder Co., Gardner, Mass.

[21] Appl. No.: 290,033

[22] Filed: Oct. 26, 1981

[51] Int. Cl.[3] ..... G09F 1/10

[52] U.S. Cl. ..... 40/124.2; 211/50; 40/405; 40/536

[58] Field of Search ..... 40/124, 124.2, 124.4, 40/360, 405, 536; 211/11, 50; 206/455

[56] References Cited

U.S. PATENT DOCUMENTS

| | | | |
|---|---|---|---|
| 2,872,185 | 2/1959 | Kropp | 40/124.2 |
| 2,981,019 | 4/1961 | Baird | 40/124 |
| 3,507,064 | 4/1970 | Hammero | 40/124.2 |
| 3,968,874 | 7/1976 | Corey | 206/248 |
| 4,102,072 | 7/1978 | Buschman | 40/124.2 |

*Primary Examiner*—Gene Mancene
*Assistant Examiner*—Wenceslao J. Contreras
*Attorney, Agent, or Firm*—Seidel, Gonda & Goldhammer

[57] ABSTRACT

The apparatus includes a card rack having a plurality of slots each aligned with an inclined channel adapted to receive a card. The rack has at least one longitudinally extending trough which communicates with each channel so that a portion of each card will be exposed in the trough. A card stripper is provided for stripping cards from the channels and through their associated slots. The card stripper has a portion receivable in the trough for contacting the ends of the cards as the stripper is moved along the trough.

13 Claims, 7 Drawing Figures

FIG. 5
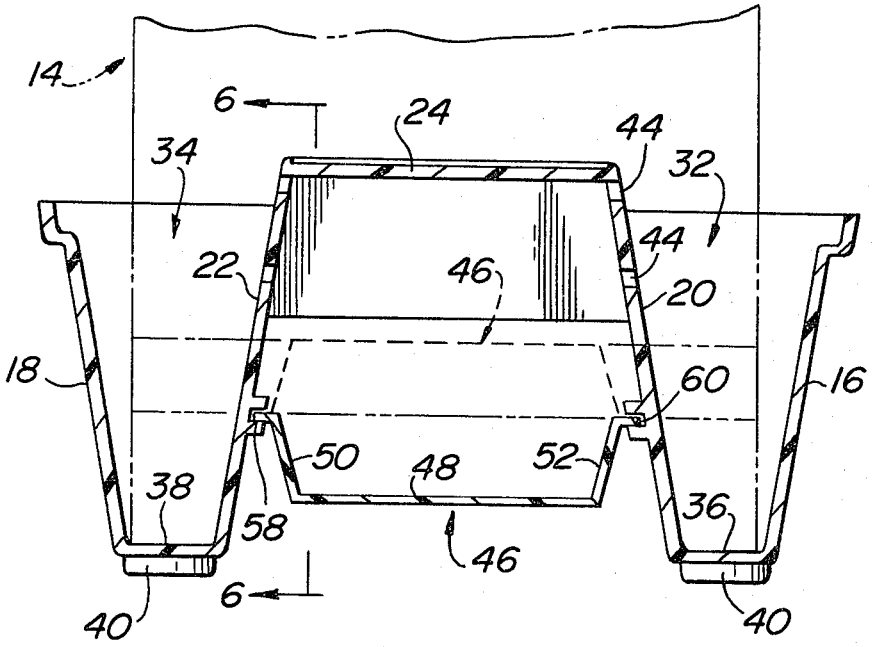
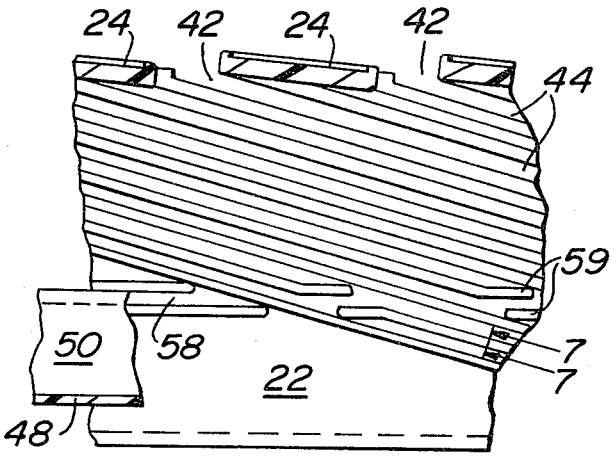
FIG. 6
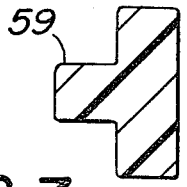
FIG. 7

CARD STORAGE APPARATUS

BACKGROUND

Many establishments use time cards as an attendance record, for computing payroll, etc. The time cards are stored in a rack mounted on a wall or the like. When it is desired to remove all of the cards from the rack to compute the payroll or for any other reason it is necessary to remove the cards one at a time. Such removal of cards is tedious and time consuming.

The present invention is directed to a solution of the problem of providing a card storage apparatus which facilitates rapid removal of all of the cards.

SUMMARY OF THE INVENTION

The present invention is directed to a card storage apparatus and includes a card rack having at least one longitudinally extending trough. The card rack has a plurality of slots each aligned with an inclined channel adapted to receive a card. Each channel communicates with the trough so that a portion of the card can be exposed in the trough. A card stripper is provided for stripping cards from the channels and through their associated slots. The card stripper has a handle portion for manipulating the stripper and a stripping portion which is receivable in the trough for contacting the ends of the cards, whereby said stripper can extract the cards into a stack as it moves along the trough.

It is an object of the present invention to provide a card storage apparatus in a manner whereby cards may be stripped from channels into a stack in a rapid facile manner.

It is another object of the present invention to provide card storage apparatus constructed in a manner so that all cards may be quickly and easily extracted into a stack.

Other objects and advantages will appear hereinafter.

For the purpose of illustrating the invention, there is shown in the drawings a form which is presently preferred; it being understood, however, that this invention is not limited to the precise arrangements and instrumentalities shown.

FIG. 5 is a sectional view taken along the line 5—5 in FIG. 4.

FIG. 6 is a sectional view taken along the line 6—6 in FIG. 5.

FIG. 7 is a sectional view taken along the line 7—7 in FIG. 6 but on an enlarged scale.

DETAILED DESCRIPTION

Figure 1:
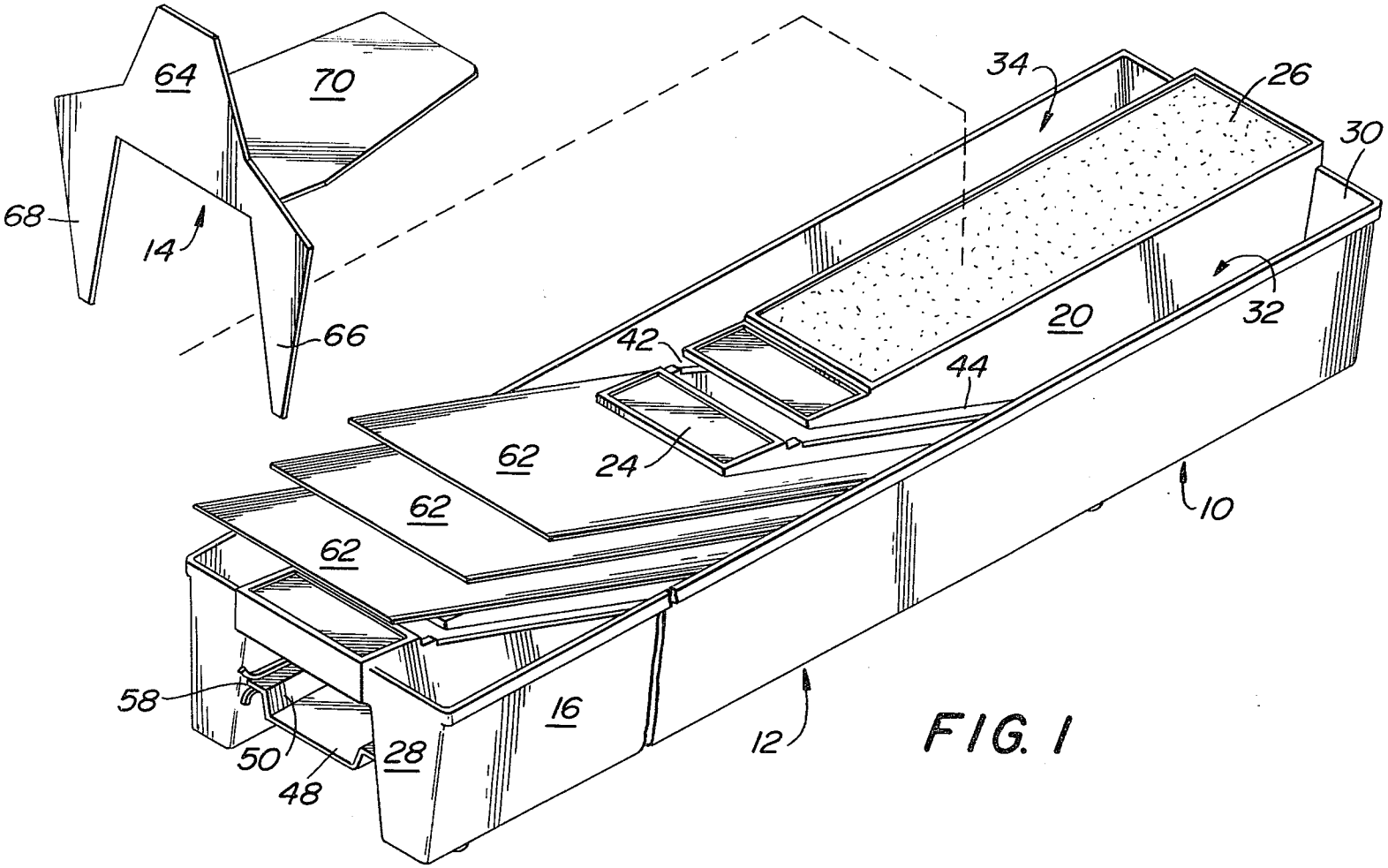
FIG. 1 is a card rack and card stripper.

Referring to the drawing in detail, wherein like numerals indicate like elements, there is shown in FIG. 1 card storage apparatus in accordance wih the present invention designated generally as 10. The apparatus 10 includes a card rack 12 and a card stripper 14. At any desirable location, such as a vertical wall, one or more of the card racks 12 may be installed depending upon the number of cards to be accommodated.

The card rack 12 in transverse section is generally W-shaped. As shown more clearly in FIG. 5, the card rack 12 has downwardly converging side walls 16, 18 with upwardly converging intermediate walls 20-22. The walls 20-22 are interconnected at spaced points by front wall segments 24 and at the bottom end by a long front wall segment 26. The card rack 12 has a top wall 28 and a bottom wall 30. Walls 16 and 20 cooperate to define a trough 32. Walls 18 and 22 cooperate to define a trough 34. While two troughs are illustrated, the card rack 12 can have only one trough if desired. The troughs 32, 34 extend for the full length of the card rack 12.

Trough 32 has a bottom wall 36. Trough 34 has a bottom wall 38. The bottom walls 36, 38 may have spacers 40 at spaced points therealong. Slots 42 are provided intermediate adjacent front wall segments 24. See FIGS. 4 and 6. Inclined card receiving channels are provided such as by the inclined slots 44 in the intermediate walls 20, 22. As shown more clearly in FIGS. 4 and 6, the upper end of each of the slots 44 commences at one of the slots 42. The slots 44 provide communication between each trough and each card receiving channel.

Figure 3:
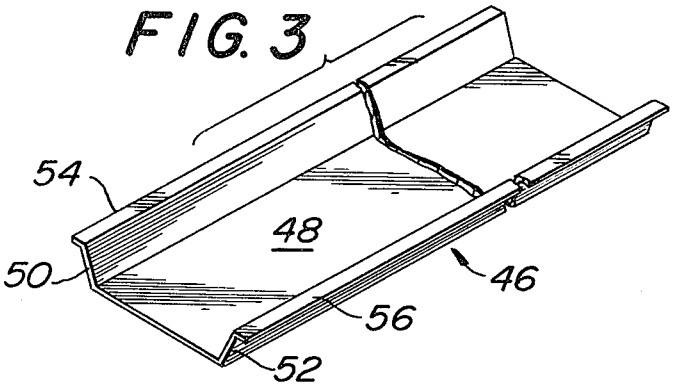
FIG. 3 is a perspective view of a card stop.

As shown more clearly in FIG. 3, a discrete card stop 46 is provided. Card stop 46 includes a center panel 48 having upwardly and outwardly inclined side walls 50, 52. Wall 50 terminates in a longitudinal flange 54 and wall 52 terminates in a similar flange 56.

As shown more clearly in FIGS. 5 and 6, the inner surface of wall 22 is provided with a guide groove 58 for receiving the flange 54. Also, the inner surface of wall 20 is provided with a guide groove 60 for receiving the flange 56. The card stop 46 extends to a limit stop 61 as shown at the righthand end of FIG. 4. In the areas where the guide grooves 58, 60 traverse the slots 44, there is provided horizontally disposed groove segments defined by flanges 59. See FIGS. 6 and 7. As shown more clearly in FIG. 5, the card stop 46 may be inverted so as to be upside down as shown in phantom.

The card stop 46 facilitates inserting cards into the slots 44 to three different depths of penetration. Miminum pentration is attained when the card stop 46 is in the phantom position shown in FIG. 5. Intermediate penetration is attained when the card stop 46 is in the position as shown in solid lines in FIG. 5. Maximum penetration of the cards is attained when the card stop 46 is completely removed so that the card occupies the full length of a slot 44. In this manner, the card rack 10 is versatile and can handle a wide variety of different lengths of cards. The present invention also obviates the situation wherein a relatively short card completely penetrates its channel as defined by the slots 44 so that the top edge of the card becomes concealed in the channel. The exposed top edge of a card may bear an employee's name or other identification which may also be placed on a label (not shown) fixed on a front wall segment 24 so that the card may be placed in the associated channel 42 reserved for the employee.

Figure 2:
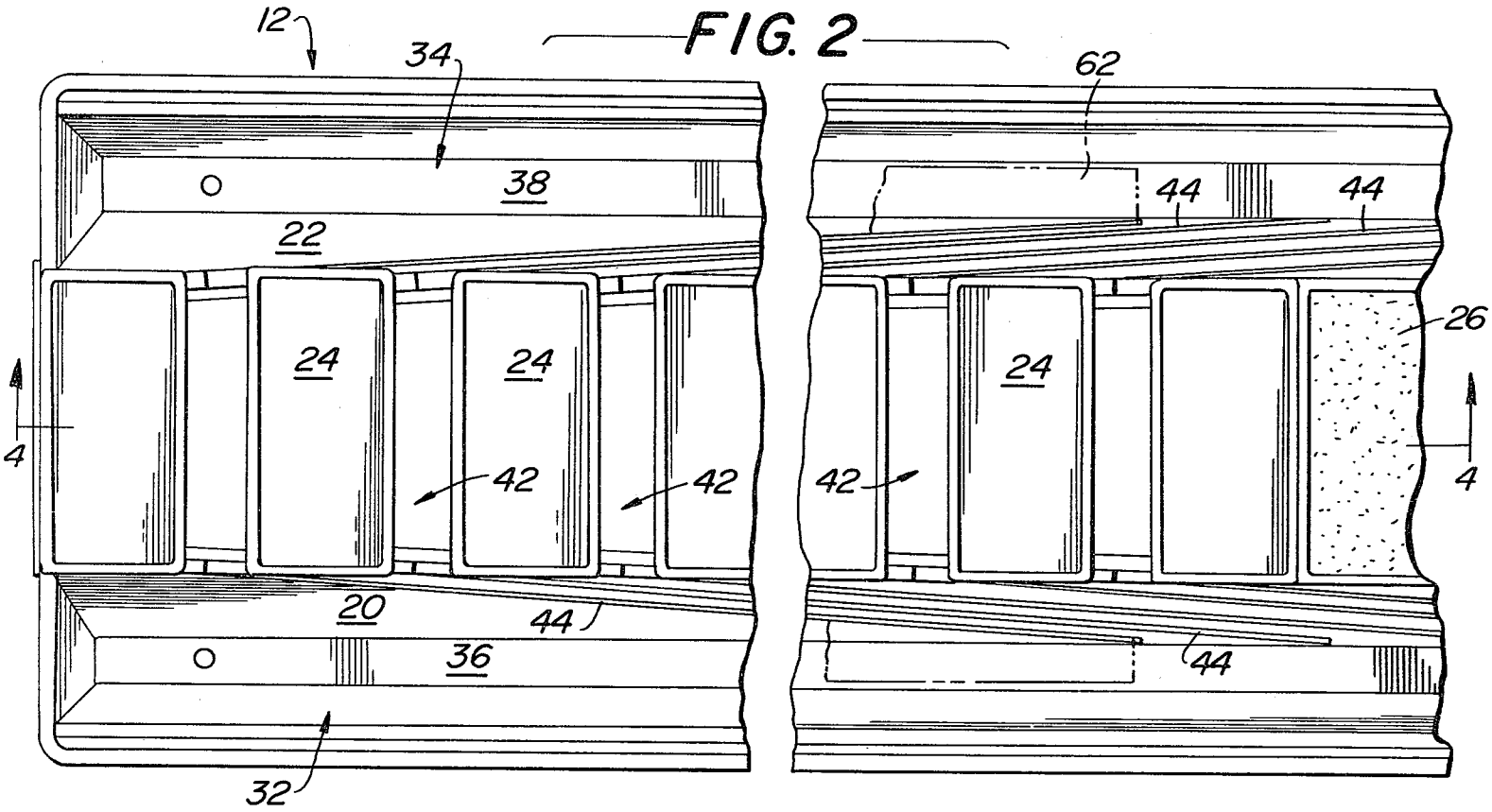
FIG. 2 is a partial top plan view of the card rack shown in FIG. 1.

The cards are designated 62. When a plurality of cards are inserted in the various channels defined by slots 44, their exposed portions overlap one another. The extent of overlap is variable by the positioning or complete withdrawal of the card stop 46. As will be apparent from FIG. 2, the cards 62 are wide enough so as to extend through their associated slots 44 into the troughs 32, 34.

Referring to FIG. 1, the card stripper 14 includes a handle portion 64 with downwardly extending stripping portions 66, 68. As shown more clearly in FIG. 5, the inner surface of the stripping portions are shaped to converge upwardly and match the convergence of walls 20, 22. The length of the portions 66, 68 is sufficient to enable a guide portion 70 to ride on the front wall segments 26 and 24 so that the cards 62 will collect underneath portion 70 as they are stripped. If desired, the stripping portions 66, 68 may extend to the bottom walls 36, 38 respectively.

The card rack 12, card stripper 14, and card stop 46 may be made from a wide variety of polymeric plastic materials such as ABS, nylon, polystyrene, etc. One advantage of the construction of the card rack 12 is that it can be injection molded in one piece. The card stop 46 may be injection molded or extruded and then cut to length.

Figure 4:
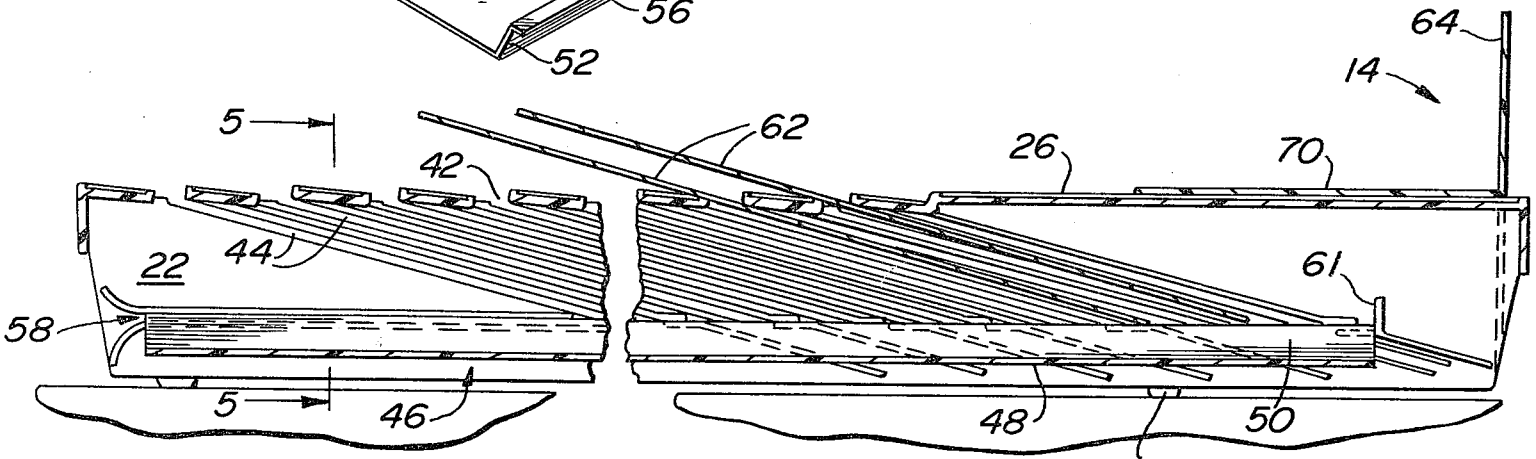
FIG. 4 is a sectional view taken along the line 4—4 in FIG. 2.

In use, the card stripper 14 is maintained by a time keeper or the like. When it is desired to strip all of the cards to a stack, the time keeper inserts the stripping portions 66, 68 of stripper 14 in the troughs 32, 34 respectively as shown in FIG. 4. While holding onto the handle portion 64, the time keeper raises the card stripper 14 with one hand while collecting all of the cards 62 with his other hand which holds the stripped cards 62 in a stack against portion 70. Thus, stripping the cards 62 is simple and rapid. Stripper 14 is not needed if the time keeper has dextrous fingers.

The present invention may be embodied in other specific forms without departing from the spirit or essential attributes thereof and, accordingly, reference should be made to the appended claims, rather than to the foregoing specification, as indicating the scope of the invention.

We claim:

1. Card storage apparatus comprising a card rack having at least one trough extending longitudinally along the rack, said card rack having a plurality of slots transversely disposed with each slot aligned with an inclined channel adapted to receive a card, each channel communicating with said trough so that a portion of each card can be exposed in the trough, and a separable card stripper for stripping cards from said channels through their associated slots, said card stripper having a handle portion for manipulating the stripper and a stripping portion receivable in said trough for contacting the exposed portions of said cards, whereby said stripper can extract the cards into a stack as it is moved along the trough, and a removable card stop supportable by the card rack for providing multiple card depth positions within said channels.

2. Apparatus in accordance with claim 1 wherein said card rack is W-shaped in transverse section so as to have a pair of side walls and a pair of intermediate walls, the intermediate walls being connected by front wall segments.

3. Apparatus in accordance with claim 2 wherein said channels are defined by inclined slots in the intermediate walls.

4. Apparatus in accordance with claim 2 wherein the card rack has a pair of troughs, each trough being defined at least in part by a side wall and an intermediate wall, said card stripper having a pair of stripping portions each adapted to be received in one of the troughs.

5. Apparatus in accordance with claim 1 wherein said card rack is a one piece molded rack made from polymeric plastic material.

6. Card storage apparatus comprising a card rack having spaced parallel troughs, said card rack having front wall means containing transverse slots between the troughs and through which cards may be inserted, said rack having an inclined channel associated with each slot, means associated with each channel to provide communication between each channel and each trough so that a portion of a card in each channel will be exposed in each trough, a discrete separable card stripper adapted to be inserted into the troughs for stripping the cards from said channels through their associated slots into a stack as the card stripper is moved along the troughs, and a removable card stop supported by said rack, said card stop being adjustable between first and second positions which define different depths to which cards may enter their associated channels.

7. Apparatus in accordance with claim 6 wherein said card rack is W-shaped in transverse section.

8. Apparatus in accordance with claim 7 wherein said troughs have one side defined by intermediate walls which converge toward the top wall means, said channels being defined by inclined slots in said intermediate walls, and said card stop being supported by said intermediate walls.

9. Apparatus in accordance of any of claims 1 or 6 wherein said removable card stop is invertable, thereby providing two different depth positions when the card stop is supported by the card rack and a third depth position when the card stop is removed from the card rack.

10. Card storage apparatus comprising a card rack having a plurality of slots transversely disposed with each slot aligned with an inclined channel adapted to receive a card, and a removable and invertable stop supported by the card rack for providing a plurality of discrete card depth positions within the channels, said card rack being W-shaped in transverse section so as to have a pair of side walls and a pair of intermediate walls, the intermediate walls being connected by front wall segments.

11. Apparatus in accordance with claim 10 wherein said channels are defined by inclined slots in the intermediate walls.

12. Apparatus in accordance with claim 10 wherein the card rack has a pair of troughs extending longitudinally along the rack, each trough being defined at least in part by a side wall and an intermediate wall, said channels communicating with said troughs, and a discrete separable card stripper for stripping cards from said channels through their associated slots into a stack, the stripper having a handle and said stripper having stripping portions receivable in said troughs.

13. Card storage apparatus comprising a card rack having a plurality of slots transversely disposed with each slot aligned with an inclined channel adapted to receive a card, and a removable and invertable card stop supportable by the card rack for providing a plurality of discrete card depth positions within the channels, said card rack being a one piece molded rack made from polymeric plastic material.

* * * * *